US010176754B2

(12) United States Patent
Kasai

(10) Patent No.: US 10,176,754 B2
(45) Date of Patent: Jan. 8, 2019

(54) ELECTRO-OPTICAL APPARATUS AND CONTROL METHOD OF ELECTRO-OPTICAL APPARATUS

(71) Applicant: SEIKO EPSON CORPORATION, Tokyo (JP)

(72) Inventor: Toshiyuki Kasai, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/404,021

(22) Filed: Jan. 11, 2017

(65) Prior Publication Data

US 2017/0221415 A1 Aug. 3, 2017

(30) Foreign Application Priority Data

Jan. 28, 2016 (JP) ..... 2016-014066

(51) Int. Cl.

| | |
|---|---|
| ***G09G 3/3233*** | (2016.01) |
| ***G09G 3/20*** | (2006.01) |
| ***G09G 3/3258*** | (2016.01) |
| ***G09G 3/3266*** | (2016.01) |
| ***G09G 3/3275*** | (2016.01) |
| ***G09G 3/00*** | (2006.01) |

(52) U.S. Cl.

CPC ..... *G09G 3/3233* (2013.01); *G09G 3/003* (2013.01); *G09G 3/2003* (2013.01); *G09G 3/3258* (2013.01); *G09G 3/3266* (2013.01); *G09G 3/3275* (2013.01); *G09G 2300/023* (2013.01); *G09G 2300/0842* (2013.01); *G09G 2300/0861* (2013.01); *G09G 2310/0221* (2013.01); *G09G 2320/064* (2013.01); *G09G 2320/0626* (2013.01); *G09G 2330/021* (2013.01)

(58) Field of Classification Search

CPC .. G09G 3/2003; G09G 3/3233; G09G 3/3258; G09G 3/3266; G09G 3/3275; G09G 2320/064; G09G 2330/021

See application file for complete search history.

(56) References Cited

U.S. PATENT DOCUMENTS

2008/0225061 A1* 9/2008 Kimura ..... G09G 3/3233 345/690

2012/0075293 A1 3/2012 Kuwabara et al.

FOREIGN PATENT DOCUMENTS

JP 2000-013715 A 1/2000
JP 2002-082305 A 3/2002

(Continued)

*Primary Examiner* — Stacy Khoo
(74) *Attorney, Agent, or Firm* — Oliff PLC

(57) ABSTRACT

An electro-optical apparatus includes a plurality of display portions and a control portion. The respective display portions have a plurality of pixels. Each of the plurality of pixels has a light-emitting element that emits light using current that is input at a predetermined cycle from a power supply line in a period from selecting a scanning line until selecting the subsequent scanning line. The control portion controls the display portions such that one of an input number of times of current from the power supply line to the light-emitting element in the period and an input time of current from the power supply line to the light-emitting element in each of the predetermined cycles changes in conjunction with each other in the display portions that are different from each other and the other changes independently from each other in the display portions that are different from each other.

6 Claims, 7 Drawing Sheets

(56) References Cited

FOREIGN PATENT DOCUMENTS

| | | | |
|---|---|---|---|
| JP | 2012-073434 | A | 4/2012 |
| JP | 2012-084955 | A | 4/2012 |
| JP | 2014-186201 | A | 10/2014 |

* cited by examiner

ELECTRO-OPTICAL APPARATUS AND CONTROL METHOD OF ELECTRO-OPTICAL APPARATUS

BACKGROUND

1. Technical Field

The present invention relates to an electro-optical apparatus and a control method of the electro-optical apparatus.

2. Related Art

An organic EL display device that is provided with organic EL elements (organic light-emitting diodes (OLED)) in a matrix shape has been commercialized to be adopted in a portable electronic apparatus, television, and the like. The organic EL element in which an organic EL layer is formed between an anode and a cathode, and emits light using current that flows between the anode and the cathode.

A head mounted display is described in JP-A-2014-186201. The head mounted display is provided with a left eye image display device and a right eye image display device, and it is possible to use the organic EL display device in the image display device. In addition, a head mounted display that uses a liquid crystal display as the left eye and right eye image display devices is described in JP-A-2000-13715. The head mounted display is able to balance luminance of a right eye liquid crystal display and a left eye liquid crystal display by operating dimming operation means of the right eye liquid crystal display and dimming operation means of the left eye liquid crystal display in a case where a user senses a difference in luminance of the left and right liquid crystal displays.

Even in a case where the organic EL display device is used as the image display device of the head mounted display, from JP-A-2014-186201 and JP-A-2000-13715 it is considered that luminance balance of the left eye organic EL display device and the right eye organic EL display device is adjusted. However, in JP-A-2000-13715, it is possible to adjust the luminance balance of the left and right liquid crystal displays, but it is not possible to adjust luminance of both liquid crystal displays while holding the luminance balance of the left and right liquid crystal displays. That is, the head mounted display is able to adjust the luminance balance, but, is not able to adjust so-called overall brightness.

In the electro-optical apparatus that has a plurality of display portions, an electro-optical apparatus is required that is able to adjust overall luminance of the plurality of display portions while adjusting luminance balance of the respective display portions. Moreover, losing luminance balance between the respective display portions by adjusting overall brightness by adjusting the luminance of each display portion is not preferable. Accordingly, an electro-optical apparatus is required that is able to independently perform adjustment of overall brightness and adjustment of the luminance balance between the respective display portions. The invention can be realized in the following aspects.

SUMMARY

According to an aspect of the invention, there is provided an electro-optical apparatus including a plurality of display portions and a control portion, in which the respective display portions have a plurality of pixels disposed corresponding to each intersecting position at which a plurality of scanning lines and a plurality of data lines intersect, each of the plurality of pixels has a light-emitting element that emits light using current that is input at a predetermined cycle from a power supply line in a period from selecting a scanning line until selecting the subsequent scanning line, and the control portion controls the display portions such that one of an input number of times of current from the power supply line to the light-emitting element in the period and an input time of current from the power supply line to the light-emitting element in each of the predetermined cycles changes in conjunction with each other in the display portions that are different from each other and the other changes independently from each other in the display portions that are different from each other.

According to another aspect of the invention, there is provided a control method of an electro-optical apparatus including a plurality of display portions and a control portion, in which the respective display portions have a plurality of pixels disposed corresponding to each intersecting position at which a plurality of scanning lines and a plurality of data lines intersect, each of the plurality of pixels has a light-emitting element that emits light using current that is input at a predetermined cycle from a power supply line in a period from selecting a scanning line until selecting the subsequent scanning line, and the control portion controls the display portions such that one of an input number of times of current from the power supply line to the light-emitting element in the period and an input time of current from the power supply line to the light-emitting element in each of the predetermined cycles changes in conjunction with each other in the display portions that are different from each other and the other changes independently from each other in the display portions that are different from each other.

In the electro-optical apparatus and the control method of an electro-optical apparatus, since current input from the power supply line to the light-emitting element is set to a predetermined cycle, the light-emitting element is driven using pulse current of the predetermined cycle. By doing this, the input number of times is a pulse number of pulse current in a period from a predetermined scanning line being selected until the subsequent scanning line is selected, and the input time is a pulse width of the pulse current. The pulse width is a temporal width. In the electro-optical apparatus and the control method of an electro-optical apparatus of the aspects of the invention, in the respective display portions, it is possible to change luminance of the respective display portions in conjunction by changing one of the pulse number and the pulse width in conjunction with each other. That is, it is possible to simultaneously brighten or darken each display portion, and it is possible to adjust overall brightness of the electro-optical apparatus. In addition, in the respective display portions, it is possible to individually change luminance of each display portion and it is possible to adjust luminance balance between the plurality of display portions by independently changing the other of the pulse number and the pulse width. Moreover, it is possible to change the pulse number and the pulse width independently from each other. Accordingly, it is possible to independently adjust overall brightness and adjust the luminance balance between the respective display portions in the electro-optical apparatus according to the aspect of the invention that is provided with the plurality of display portions.

In addition, the electro-optical apparatus may be configured such that there is a pair of display portions, one display portion is visually recognized by one eye of a person, and the other display portion is visually recognized by the other eye of the person.

In this case, for example, the electro-optical apparatus is able to be applied to a head mounted display. In this case, it is possible to respectively and independently adjust the luminance balance and adjust overall brightness on the left and right of the head mounting display.

In addition, the electro-optical apparatus may be configured such that the display portion emits light of different colors from each other, and superimposes light that is emitted from respective display portions on each other.

In this case, for example, if a display portion emits red light, a display portion emits blue light, and a display portion emits green light, the electro-optical apparatus is able to display color. Moreover, it is possible to adjust overall brightness of color display and it is possible to adjust white balance of superimposed light by adjusting luminance balance of the respective display portions. As such an electro-optical apparatus, for example, it is possible to give a projector.

In addition, the electro-optical apparatus may be configured such that the control portion controls the display portions such that an input number of times of current from the power supply line to the light-emitting element in the period changes in conjunction with each other in the display portions that are different from each other and the input time of current from the power supply line to the light-emitting element in each of the predetermined cycles changes independently from each other.

In the electro-optical apparatus, adjustment of overall brightness of the electro-optical apparatus is performed by changing the pulse number and adjustment of luminance balance of each display portion is performed by changing the pulse width. In a case where the pulse width is extremely small, it is necessary to control at high frequency, fast reaction speed of the pixel circuit or a fast processing speed of the control portion is required, and there is a tendency for load applied to the pixel circuit or the control portion to be increased. Accordingly, it is preferable that the pulse width be barely changed. Meanwhile, even in a case where the pulse number is largely changed, the load on the pixel circuit or the control portion is barely changed. In addition, when luminance of the display portion is changed in order to adjust luminance balance between display portions, change of the luminance is typically not particularly increased, but luminance of the display portion for adjusting overall brightness being greatly changed is typical. Accordingly, in the electro-optical apparatus, even in a case where the overall brightness is greatly changed, it is possible to suppress load on a circuit portion or the control portion becoming large.

In addition, the electro-optical apparatus may be configured such that the predetermined cycle is a cycle in which respective scanning lines are sequentially selected.

The control portion is able to use the cycle in which the scanning lines are sequentially selected when the predetermined cycle is managed by setting the predetermined cycle in which the light-emitting element is driven using pulse current to a cycle in which the respective scanning lines are sequentially selected. Accordingly, in the electro-optical apparatus, it is possible to mitigate the load on the control portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

A preferable embodiment of an electro-optical apparatus and a control method of the electro-optical apparatus according to the invention will be described below in detail with reference to the drawings. Note that, the embodiment exemplified below is made for ease of understanding of the invention, and the invention is not to be interpreted as being limited. The invention is able to be modified and improved without departing from the gist of the invention. In addition, in the description below, in a case of "connection", there are cases in which a meaning is included of electrically connecting.

First Embodiment

Figure 1:
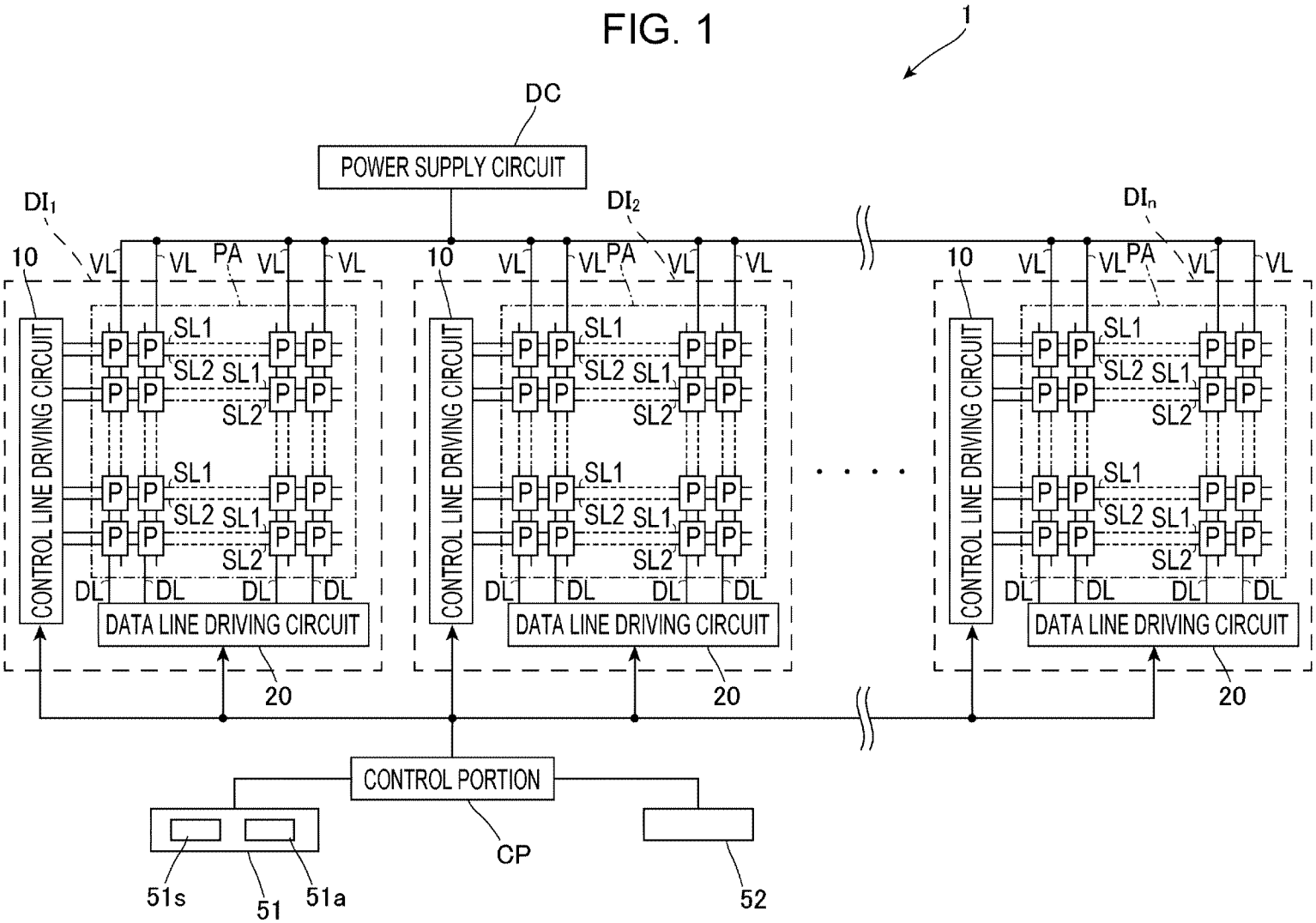
FIG. 1 is a schematic view illustrating an electro-optical apparatus according to a first embodiment of the invention.

FIG. 1 is a schematic view illustrating an electro-optical apparatus according to a first embodiment of the invention. As shown in FIG. 1, an electro-optical apparatus 1 of the present embodiment is provided with a plurality of display portions $DI_1$, $DI_2$, . . . , $DI_n$, a control portion CP that controls the respective display portions $DI_1$ to $DI_n$, a luminance balance adjustment input portion 51, an overall brightness adjustment input portion 52, and a power supply circuit DC. Note that, in the electro-optical apparatus 1 provided with at least two display portions, the number is not particularly limited.

In the present embodiment, the respective display portions $DI_1$ to $DI_n$ have the same configuration as each other, and are provided with pixel array PA in which a plurality of pixels P are arranged in a matrix, a control line driving circuit 10, and a data line driving circuit 20.

The pixel array PA is provided with a plurality of first control lines SL1 that are a plurality of scanning lines extending generally in a horizontal direction, a plurality of second control lines SL2 that are a plurality of light emission control lines extending generally in the horizontal direction paired with the first control lines SL1, and a plurality of data lines DL extending generally in a vertical direction. Each first control line SL1 and each second control line SL2 are connected to the control line driving circuit 10, and each data line DL is connected to the data line driving circuit 20. In addition, each data line DL intersects with each first control line SL1, and each pixel P is arranged corresponding to each position at which the respective first control lines SL1 that are scanning lines and the respective data lines DL intersect. By doing this, each pixel P is regularly arranged in a matrix shape, that is, a horizontal and vertical grid shape, and each pixel array PA has a plurality of pixel rows and a plurality of pixel columns. The number of pixel rows that each pixel array PA has is not particularly limited, but for example, is 720. In addition, a power supply line VL extends from the power supply circuit DC, and each power supply line VL is connected to each pixel P. By doing this, the power supply circuit DC supplies power to the respective pixels P via the power supply line VL.

Note that, although not particularly illustrated, each pixel P may be configured by a plurality of sub pixels corresponding to, for example, the three primary colors of red (R), blue (B), and green (G). In this case, red, blue, and green are regularly lined up in order, for example, in the horizontal direction, and color display is possible in each display portion $DI_1$ to $DI_n$. In addition, for example, each pixel P may be single colors within the respective pixel arrays PA. In this case, the same color may be displayed in each display portion $DI_1$ to $DI_n$, or are configured such that each display portion $DI_1$ to $DI_n$ is different, but colors that are different from each other may be displayed in each display portion $DI_1$ to $DI_n$.

The control portion CP controls each display portion $DI_1$ to $DI_n$. In detail, the control portion CP controls the control line driving circuit 10 and the data line driving circuit 20 within each display portion $DI_1$ to $DI_n$ such that the control line driving circuit 10 and the data line driving circuit 20 in the respective display portions $DI_1$ to $DI_n$ are operated in conjunction with each other by generating and outputting a control signal.

The control line driving circuit 10 is mainly configured by a shift register, an output circuit, and the like, a write signal is applied to the respective first control lines SL1, and a light emission control signal is applied to the respective second control lines SL2. In detail, the control line driving circuit 10 sequentially selects the first control lines SL1 at a shifted timing based on the control signal from the control portion CP, and the write signal is applied to the selected first control lines SL1. By such line sequential scanning, the pixel rows equivalent to a pixel group for one horizontal line are selected in order one at a time in one vertical scanning period. In addition, the control line driving circuit 10 applies the light emission control signal that is repeated a predetermined number by a voltage of a predetermined pulse width in a predetermined cycle in the second control line SL2 which is connected to each pixel P of the same pixel row as the first control line SL1 in a state in which the first control line SL1 is not selected based on the control signal from the control portion CP.

The data line driving circuit 20 is mainly configured by the shift register, a line latch circuit, an output circuit, and the like, the data signal of the voltage that is individually applied to the data line DL connected to the data line driving circuit 20 is generated, and the generated data signal is applied to each data line DL based on the control signal from the control portion CP. In detail, the data line driving circuit 20 generates the data signal equivalent to display gradation of each pixel P based on a video signal that is input from outside. Then, when the predetermined first control line SL1 is selected by the control line driving circuit 10, the data signal is output equivalent to the display gradation of the respective pixels P that are connected by the selected first control line SL1, and when a subsequent first control line SL1 is selected, the data signal is output equivalent to the display gradation of the respective pixels P that are connected by the selected first control line SL1.

Note that, details of the application of each signal by the data line driving circuit 20 and the control line driving circuit 10 will be described.

The luminance balance adjustment input portion 51 is an interface that inputs a signal for adjusting luminance balance between each display portion to the control portion CP by adjusting the luminance of a specific display portion out of the respective display portions $DI_1$ to $DI_n$. The luminance balance adjustment input portion 51 of the embodiment has a display portion selecting unit 51*s* and a luminance adjustment input portion 51*a*. The display portion selecting unit 51*s* is an interface that selects a display portion that adjusts luminance out of the respective display portions $DI_1$ to $DI_n$, and the luminance adjustment input portion 51*a* is an interface that inputs a command that relatively raises or lowers luminance of the selected display portion with respect to another display portion.

The overall brightness adjustment input portion 52 is an interface that inputs a command that raises or lowers luminance of all display portions $DI_1$ to $DI_n$.

Figure 2:
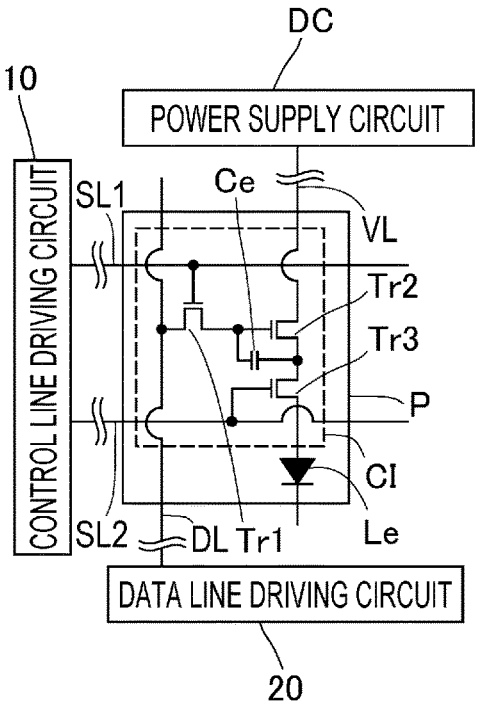
FIG. 2 is a diagram schematically illustrating an example of a configuration of a pixel in FIG. 1.

FIG. 2 is a diagram schematically illustrating an example of a configuration of each pixel P in each pixel array PA. The respective pixels P are provided with a pixel circuit CI that includes a first transistor Tr1, a second transistor Tr2, a third transistor Tr3, and a capacitative element Ce, and a light-emitting element Le. The pixel circuit has a function of setting a level of current that is input from a power supply line VL to the light-emitting element Le according to the data signal that is input from the data line DL. For example, a data signal is input to a gate of the second transistor Tr2, and the current is set according to the gate voltage of the second transistor Tr2.

The first transistor Tr1, the second transistor Tr2, and the third transistor Tr3 are respective N channel transistors, and for example, are formed using a single-crystal transistor or a thin-film transistor (TFT) that is provided on a silicon substrate. Note that, the type of transistor is not particularly limited. In addition, for example, the light-emitting element Le is a light-emitting element of a current driving type such as an organic EL element. In addition, the capacitative element Ce may be formed by a thin-film capacitor, and may be formed by a gate capacitor and the like of the second transistor Tr2.

The first transistor Tr1 is a transistor for writing, the gate is connected to the first control line SL1, one of a source and a drain is connected to the data line DL, and the other of the source and the drain is connected to the gate of the second transistor Tr2. The second transistor Tr2 is a transistor for gradation control, one of the source and the drain is connected to the power supply line VL, and the other of the source and the drain is connected to one of the source and drain of the third transistor Tr3. The third transistor Tr3 is a transistor for light emission control, the gate is connected to the second control line SL2, and the other of the source and the drain is connected to an anode of the light-emitting element Le. In addition, a cathode of the light-emitting element Le is connected to a part in that has a predetermined potential such as a ground potential. In addition, one pole of the capacitative element Ce is connected to the other of the source and the drain of the first transistor Tr1 and the gate of the second transistor Tr2, and the other pole of the capacitative element Ce is connected to the other of the source and the drain of the second transistor Tr2 and the one of the source and drain of the third transistor Tr3.

Next, light emission of each pixel P in the display portions $DI_1$ to $DI_n$ will be described.

Figure 3:
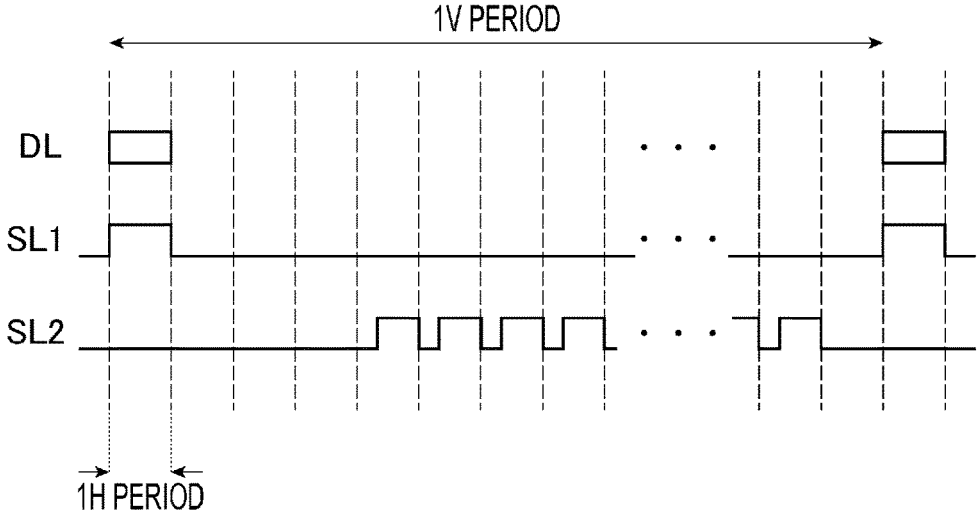
FIG. 3 is a diagram schematically illustrating a circumstance of a signal that is applied to a predetermined pixel.

FIG. 3 is a diagram schematically illustrating a circumstance of a writing signal, a data signal, and a light emission control signal that are applied to a predetermined pixel.

In each display portion $DI_1$ to $DI_n$, the control portion CP controls the control line driving circuit 10 of each display portion $DI_1$ to $DI_n$ such that the first control line SL1 is sequentially selected in every one horizontal scanning period (1H period) and each first control line SL1 is selected one at a time within one vertical scanning period (1V period). One vertical scanning period is, for example, 1/60 seconds. For example, in a case where the pixel row number (scanning line number) of the pixel array PA as described above is 720 and one vertical scanning period is 1/60 seconds, one horizontal scanning period is roughly 20 μsec. In the embodiment, in the period in which the predetermined first control line SL1 is selected (writing period), the control line driving circuit 10 applies the writing signal to the predetermined first control line SL1. In the embodiment, the writing signal is applied by applying an H level to the first control line SL1. In addition, in the embodiment, the period in which one first control line SL1 is selected is equal to roughly one horizontal scanning period.

The period in which the predetermined first control line SL1 is selected is a writing period of each pixel P that is connected to the first control line SL1, and in the period, in the pixels P, a gate voltage of the first transistor Tr1 is raised by setting the voltage that is applied to the first control line SL1 to the H level. By raising the gate voltage, the first transistor Tr1 is in an on state, that is, a state in which current flows between the drain and source of the first transistor Tr1. Accordingly, voltage of the data signal that is applied from the data line driving circuit 20 via the data line DL is applied to the gate of the second transistor Tr2 and the capacitative element Ce. According to the voltage, the capacitative element Ce is charged, and voltage is held based on the data signal. In addition, when the gate voltage of the second transistor Tr2 is raised according to the voltage of the data signal, the second transistor Tr2 is in an on state, that is, a state in which current flows between the drain and source. At that time, the intensity of current that is able to flow between the drain and the source of the second transistor Tr2 is based on the gate voltage of the second transistor Tr2. Accordingly, the intensity of current that is able to flow between the drain and the source of the second transistor Tr2 is based on the voltage of the data signal that is applied to the data line DL.

However, in the writing period, the control portion CP controls the control line driving circuit 10 such that the control line driving circuit 10 applies an L level to the second control line SL2. Accordingly, the gate voltage of the third transistor Tr3 is at the L level, and the third transistor Tr3 is in an off state, that is, a state in which current flow between the drain and source is suppressed. Accordingly, a current input from the power supply line VL to the light-emitting element Le is suppressed. Therefore, even in a state in which current is able to flow between the drain and the source of the second transistor Tr2 described above, the current path from the power supply line VL to the light-emitting element Le is blocked, and the current from the power supply line VL is suppressed from flowing between the anode and cathode of the light-emitting element Le. That is, in the writing period, the light-emitting element Le does not emit light.

Next, when roughly one horizontal scanning period elapses from the predetermined first control line SL1 being selected, the selection period of the first control line SL1 ends, and the control portion CP controls the control line driving circuit 10 such that the control line driving circuit 10 sets the voltage of the first control line SL1 to the L level. Accordingly, the gate voltage of the first transistor Tr1 is lowered, and the first transistor Tr1 is in the off state in which flow of current between the drain and source is suppressed. Therefore, one pole of the gate of the second transistor Tr2 and the capacitative element Ce is in a floating state, and the gate voltage of the second transistor Tr2 is roughly held at a voltage based on the voltage of the data signal. Note that, since the first control line SL1 is selected once in one vertical scanning period, the control portion CP controls the control line driving circuit 10 such that the voltage of the first control line SL1 is at the L level until the subsequent first control line SL1 is selected.

After the period in which the first control line SL1 is selected ends, the control portion CP controls the control line driving circuit 10 such that the voltage of the second control line SL2 is maintained at the L level without change in a short period. The period is, for example, two to three horizontal scanning periods. However, the period in which the voltage of the second control line SL2 is maintained at the L level without change after the selection period of the first control line SL1 ends as in the embodiment is not essential.

Next, after the period has elapsed from the selection period of the first control line SL1 ending, the control portion CP controls the control line driving circuit 10 such that the control line driving circuit 10 applies to the second control line SL2 a voltage at which there is a light emission control signal with a predetermined pulse width in a predetermined period to the second control line SL2. In the embodiment, the predetermined cycle of the light emission control signal as shown in FIG. 3 is a cycle in which the respective first control lines SL1 are sequentially selected, and is synchronized in each horizontal scanning period. Accordingly, the pulse width in a state in which the voltage of the light emission control signal is at the H level is shorter than one horizontal scanning period.

The gate voltage of the third transistor Tr3 is raised accompanying the voltage that is applied to the second control line SL2 being set to the H level, and the third transistor Tr3 is in an on state, that is, a state in which current flows between the drain and the source. When the third transistor Tr3 is in the on state, a current path passes from the power supply line VL to the light-emitting element Le, current is input from the power supply line VL to the light-emitting element Le and the current flows between the anode and the cathode. Accordingly, the third transistor Tr3 repeats the on state and the off state in the predetermined cycle by applying voltage of a pulse shape of a predetermined cycle to the second control line SL2 described above and conduction and blocking of the current path are switched in the predetermined cycle from the power supply line VL to the light-emitting element Le. By doing this, current from the power supply line VL is input at the predetermined cycle to the light-emitting element Le in synchronization with the on state of the third transistor Tr3, and the light-emitting element Le emits light at the predetermined cycle. Accordingly, the input number of times and input time of current from the power supply line VL is adjusted by controlling the third transistor Tr3 using voltage of the second control line. At this time, since the intensity of current that is able to flow between the drain and the source of the second transistor Tr2 is fixed based on the voltage that is applied to the data line described above, luminance is fixed when the light-emitting element Le emits light based on the voltage of the data signal and there is a gradation control of the light-emitting element Le.

Note that, in the embodiment, since the light-emitting element Le is a light-emitting element of a current driving type such as an organic EL element described above, the light-emitting element Le has early reaction performance in comparison to liquid crystal and the like. Accordingly, even in a case where one horizontal scanning period described above is a short period of roughly 20 μsec, it is possible for the light-emitting element Le to emit light and extinguish light in synchronization with switching the third transistor Tr3 on and off.

Then, when the period is a predetermined horizontal scanning period prior to the period in which the first control line SL1 that the pixel P is connected to is subsequently selected, the control portion CP controls the control line driving circuit 10 and stops application of the voltage of the pulse shape to the second control line SL2 to which the pixel P is connected. Accordingly, the voltage of the pulse shape is not applied to the third transistor Tr3, and the voltage that is applied to the third transistor Tr3 is at the L level.

Note that, in the embodiment, in one vertical scanning period, the pulse number and the pulse width that is applied to each second control line SL2 is the same in one display portion. The pulse width is a temporal width, and is equivalent to a conduction time of the current path from the power supply line VL to the light-emitting element Le in each predetermined cycle, that is, an input time of current to the light-emitting element Le. Accordingly, the number of times at which each light-emitting element Le that is positioned inside the same pixel array PA periodically emits light within one vertical scanning period are the same as each other, or the light emission times at which each light-emitting element Le that is positioned within the same pixel array PA emit light per predetermined cycle are the same as each other.

Next, adjustment of the overall brightness in the electro-optical apparatus 1 of the embodiment will be described.

In the electro-optical apparatus 1, in a case where adjustment of overall brightness is performed, luminance of each display portion $DI_1$ to $DI_n$ is changed in conjunction. In this case, the user operates the overall brightness adjustment input portion 52. In detail, the user inputs a command in which the luminance of each display portion $DI_1$ to $DI_n$ is raised or inputs a command in which the luminance is lowered. When the user inputs a command to the overall brightness adjustment input portion 52, information is input to the control portion CP based on the command.

Figure 4:
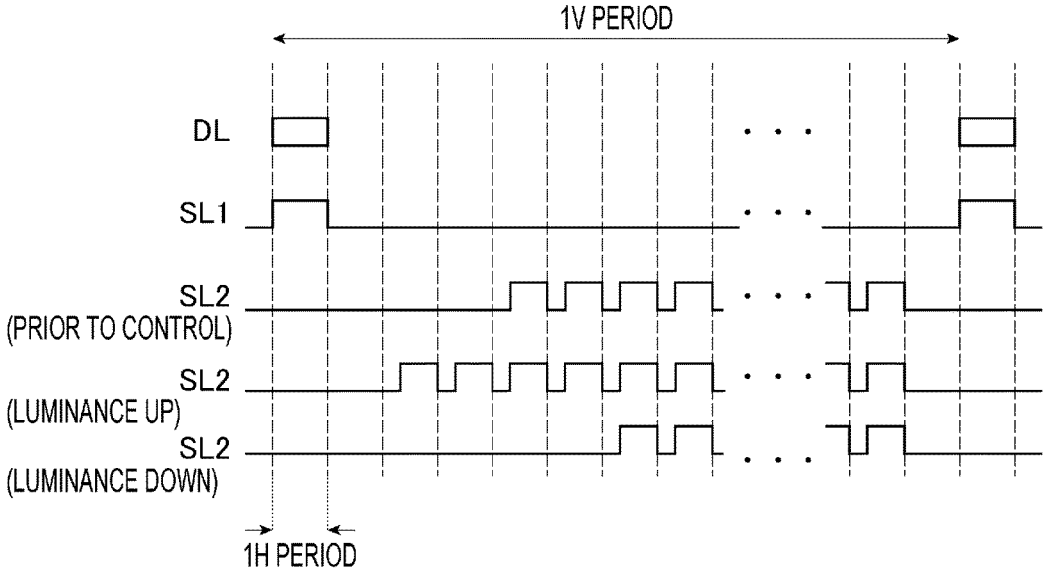
FIG. 4 is a diagram schematically illustrating a circumstance of change of a signal that is applied to each pixel in all display portions in a case where overall brightness is adjusted.

By doing this, the control portion CP controls the control line driving circuit 10 of all display portions $DI_1$ to $DI_n$. FIG. 4 is a diagram schematically illustrating corresponding to FIG. 3 a circumstance of change of a signal that is applied to each pixel in all display portions $DI_1$ to $DI_n$ in a case where overall brightness is adjusted.

In a case where the command in which the user raises the overall brightness is input to the overall brightness adjustment input portion 52, the control portion CP controls each control line driving circuit 10 such that the pulse number is increased per one vertical scanning period of the light emission control signal of the pulse shape in which the control line driving circuit 10 of each display portion $DI_1$ to $DI_n$ is applied to the each second control line SL2. By doing this, each control line driving circuit 10 of each display portion $DI_1$ to $DI_n$ increases the pulse number per one vertical scanning period only for a predetermined pulse in addition to the pulse prior to the control such that luminance UP is indicated in FIG. 4. At this time, the pulse width of the increased pulse is the same as the pulse width of another pulse. The number of times where the third transistor Tr3 is set to on is increased and the number of times of conduction of a current path from the power supply line VL to the light-emitting element Le is increased due to the pulse number of such a light emission control signal becoming great. Accordingly, the number of times of light emission of the light-emitting element Le is increased by increasing the input number of times of current to the light-emitting element Le per one vertical scanning period. Therefore, the total of the light emission time of each light-emitting element Le in one vertical scanning period in each display portion $DI_1$ to $DI_n$ is long, and an average luminance of each display portion $DI_1$ to $DI_n$ is raised. By doing this, overall luminance of each display portion $DI_1$ to $DI_n$ is raised.

In addition, in a case where the command which the user lowers the overall brightness is input to the overall brightness adjustment input portion 52, the control portion CP controls each control line driving circuit 10 such that the pulse number is reduced per one vertical scanning period of the light emission control signal of the pulse shape in which the control line driving circuit 10 of each display portion $DI_1$ to $DI_n$ is applied to the each second control line SL2. By doing this, each control line driving circuit 10 of each display portion $DI_1$ to $DI_n$ reduces the pulse number per one vertical scanning period only for a predetermined pulse from the pulse prior to the control such that luminance DOWN is indicated in FIG. 4. The number of times where the third transistor Tr3 is set to on is reduced and the number of times of conduction of a current path from the power supply line VL to the light-emitting element Le is reduced due to the pulse number of such a light emission control signal becoming small. Accordingly, the number of times of light emission of the light-emitting element Le is reduced by reducing the input number of times of current to the light-emitting element Le per one vertical scanning period. Therefore, the total of the light emission time of each light-emitting element Le in one vertical scanning period in each display portion $DI_1$ to $DI_n$ is short, and an average luminance of each display portion $DI_1$ to $DI_n$ is lowered. By doing this, overall luminance of each display portion $DI_1$ to $DI_n$ is lowered.

In this manner, in the electro-optical apparatus 1 of the embodiment, in a case where the overall brightness is adjusted, in the display portions that are different from each other, the overall brightness is adjusted by changing the number of times of conduction of the current path in a period from the predetermined first control line SL1 being selected until the subsequent first control line SL1 is selected in conjunction with each other. Accordingly, the overall brightness is adjusted by changing the input number of times of current of the light-emitting element Le per one vertical scanning period in conjunction with each other.

Next, adjustment of the luminance balance in each display portion $DI_1$ to $DI_n$ in the electro-optical apparatus 1 of the embodiment will be described.

In the electro-optical apparatus 1, in a case where the luminance balance is adjusted, luminance of each display portion $DI_1$ to $DI_n$ is individually and independently changed. In this case, first, the user selects the display portion in which the luminance is relatively changed with respect to another display portion. In that case, first, the user selects the display portion in which luminance from the display portion selecting unit 51*s* of the luminance balance adjustment input portion 51 is desired to be changed. By doing this, the selection information from the display portion selecting unit 51*s* is input to the control portion CP, and the control portion CP stores the selection information.

Next, the user operates the luminance adjustment input portion 51*a*. In detail, the user inputs a command in which luminance of the display portion selected by the display portion selecting unit 51*s* is relatively raised with respect to the luminance of another display portion or a command in which luminance is lowered from the luminance adjustment input portion 51*a*. When the user inputs a command to the luminance adjustment input portion 51*a*, information is input to the control portion CP based on the command.

Figure 5:
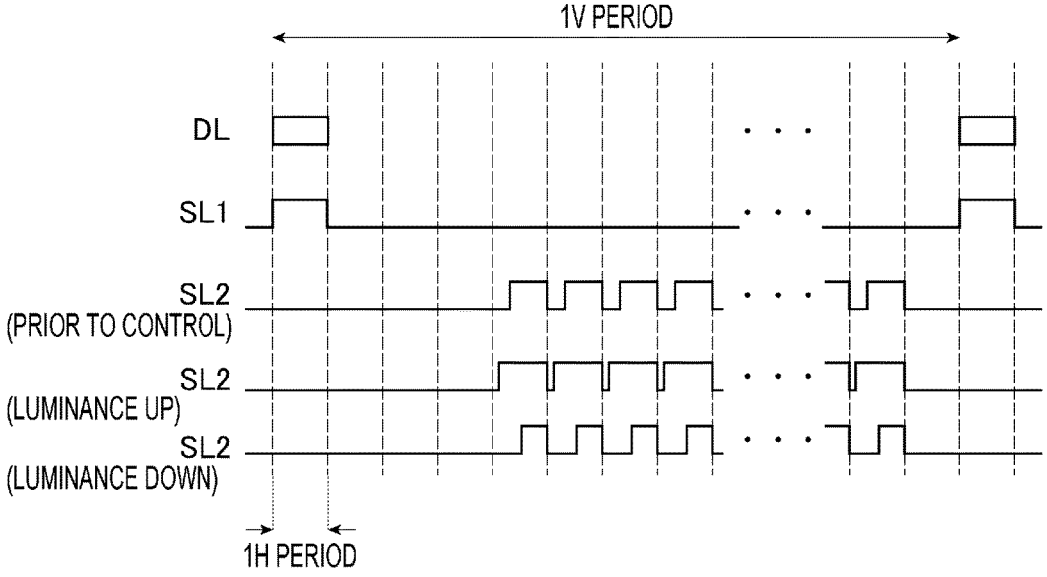
FIG. 5 is a diagram schematically illustrating a circumstance of change of the signal that is applied to each pixel of the display portion in which luminance is changed in a case where luminance balance is adjusted.

By doing this, the control portion CP controls the control line driving circuit 10 of the display portion based on the stored selection information. FIG. 5 is a diagram schematically illustrating corresponding to FIG. 3 a circumstance of change of the signal that is applied to each pixel of the display portion in which luminance is changed in a case where luminance balance is adjusted.

In a case where the command in which the luminance of the display portion selected by the user is relatively raised with respect to the luminance of the other display portion is input to the luminance adjustment input portion 51*a*, the control portion CP controls the control line driving circuit 10 such that the control line driving circuit 10 of the display portion increases the pulse width of the light emission control signal which is applied to each second control line SL2. Accordingly, as indicated by luminance UP in FIG. 5, the control line driving circuit 10 lengthens the period in which the voltage that is applied to each second control line SL2 in each horizontal period is set to the H level. At this time, in the embodiment, the pulse width is increased by hastening the timing of raising the voltage of each pulse shape of the light emission control signal. The time that the third transistor Tr3 is set to on is lengthened and the conductive time of the current path from the power supply line VL to the light-emitting element Le is lengthened due to the pulse width of such a light emission control signal becoming large. Accordingly, the light emission time of the light-emitting element Le is lengthened by lengthening the input time of the current to the light-emitting element Le in each horizontal period. Therefore, the light emission time of each light-emitting element Le in one vertical scanning period is lengthened, and an average luminance of the selected display portion is raised.

In addition, in a case where the command in which the luminance of the display portion selected by the user is relatively lowered with respect to the luminance of the other display portion is input to the luminance adjustment input portion 51*a*, the control portion CP controls the control line driving circuit 10 such that the control line driving circuit 10 of the display portion reduces the pulse width of the light emission control signal which is applied to each second control line SL2. Accordingly, as indicated by luminance DOWN in FIG. 5, the control line driving circuit 10 shortens the period in which the voltage of the light emission control signal is set to the H level. At this time, in the embodiment, the pulse width is reduced by slowing the timing of raising of each pulse shape of the light emission control signal. The time that the third transistor Tr3 is set to on is shortened and the conductive time of the current path from the power supply line VL to the light-emitting element Le is shortened in each period due to the pulse width of such a light emission control signal becoming small. Accordingly, the light emission time of the light-emitting element Le is shortened by shortening the input time of the current to the light-emitting element Le in each horizontal period. Therefore, the total light emission time of each light-emitting element Le in one vertical scanning period is shortened, and an average luminance of the selected display portion is lowered.

In this manner, in the electro-optical apparatus 1 of the embodiment, in a case where the luminance balance is adjusted, in the display portions that are different from each other, the display portion that is selected by the control portion CP is controlled such that the conduction times of the current path of each predetermined cycle are changed independently from each other. In this manner, the light emission time is changed in each cycle of each light-emitting element Le that is lit in the pulse shape in the predetermined cycle in the selected display portion, and the luminance balance is adjusted.

Summation

As described above, in the electro-optical apparatus 1 of the embodiment, as described above, the overall brightness is adjusted by changing the input number of times of current from the power supply line VL to the light-emitting element Le in the period by changing the number of times of conduction of the current path in the period from the predetermined first control line SL1 being selected until the subsequent first control line SL1 is selected. In addition, the luminance balance is adjusted by changing the input time of current from the power supply line VL to the light-emitting element Le in each predetermined cycle by changing the conduction time of the current path in each predetermined cycle. It is possible to adjust the conduction time of the current path in each predetermined cycle and the number of times of conduction of the current path in the period from the predetermined first control line SL1 being selected until the subsequent first control line SL1 is selected independently from each other. That is, the control portion CP is able to independently adjust the input number of times of current from the power supply line VL to the light-emitting element Le in the period and the input time of current from the power supply line VL to the light-emitting element Le in each predetermined cycle. Accordingly, it is possible to independently perform adjustment of overall brightness and adjustment of the luminance balance between the respective display portions according to the electro-optical apparatus 1 of the embodiment.

Note that, in the embodiment, as described above, in the display portions that are different from each other, the control portion CP changes the number of times of conduction of the current path in the period from the predetermined first control line SL1 being selected until the subsequent first control line SL1 is selected in conjunction with each other, and controls the display portions $DI_1$ to $DI_n$ so as to change the conduction time of the current path in each predetermined cycle independently from each other. That is, in the display portions that are different from each other, an input number of times of current from the power supply line VL to the light-emitting element Le in the period in conjunction with each other, and the display portions $DI_1$ to $DI_n$ are controlled such that the input time of current from the power supply line VL to the light-emitting element Le in each predetermined cycle are changed independently from each other. However, in the invention, in the display portions that are different from each other, the control portion CP may change the number of times of conduction of the current path in the period from the predetermined first control line SL1 being selected until the subsequent first control line SL1 is selected independently from each other, and control the display portions $DI_1$ to $DI_n$ so as to change the conduction time of the current path in each predetermined cycle in conjunction with each other. In this case, the luminance balance is adjusted by changing the input number of times of current from the power supply line VL to the light-emitting element Le by changing the number of times of conduction of the current path in the period from the predetermined first control line SL1 being selected until the subsequent first control line SL1 is selected and the overall brightness is adjusted by changing the input time of current from the power supply line VL to the light-emitting element Le by changing the conduction time of the current path in each predetermined cycle.

However, in this case, in a case where the overall brightness is darkened, the pulse width may be extremely small. In a case where the pulse width is extremely small, fast reaction speed of the pixel circuit CI or a fast processing speed of the control portion CP that it is necessary to control at high frequency is required, and there is a tendency for load applied to the pixel circuit CI or the control portion CP to be increased. Meanwhile, even in a case where the pulse number is changed, the load on the pixel circuit CI or the control portion CP is barely changed. In addition, typically, greatly changing luminance of the display portion in order to adjust luminance balance between display portions is rare, but luminance of the display portions $DI_1$ to $DI_n$ for adjusting overall brightness being greatly changed is typical. Accordingly, in the embodiment, in the display portions that are different from each other, the control portion CP changing the number of times of conduction of the current path in the period from the predetermined first control line SL1 being selected until the subsequent first control line SL1 is selected in conjunction with each other, and controlling the display portions $DI_1$ to $DI_n$ so as to change the conduction time of the current path in each predetermined cycle independently from each other is preferable.

In addition, in the embodiment, a predetermined cycle in which a light emission driving signal is applied to the second control line SL2 is a cycle in which respective first control lines SL1 are sequentially selected, but may be a cycle that is different from the predetermined cycle and a cycle in which the first control lines SL1 are sequentially selected. However, the predetermined cycle in which the light emission driving signal is applied to the second control line SL2 is a cycle in which respective first control lines SL1 are sequentially selected, and therefore, when the predetermined cycle is managed, the control portion CP is preferably able to use the cycle in which the first control lines SL1 are sequentially selected and able to mitigate the load on the control portion CP.

Second Embodiment

Next, a second embodiment of the invention will be described in detail with reference to FIG. 6. Note that, except as specifically described, the same or similar configuration elements as the first embodiment are given the same reference numerals and overlapping description is omitted.

Figure 6:
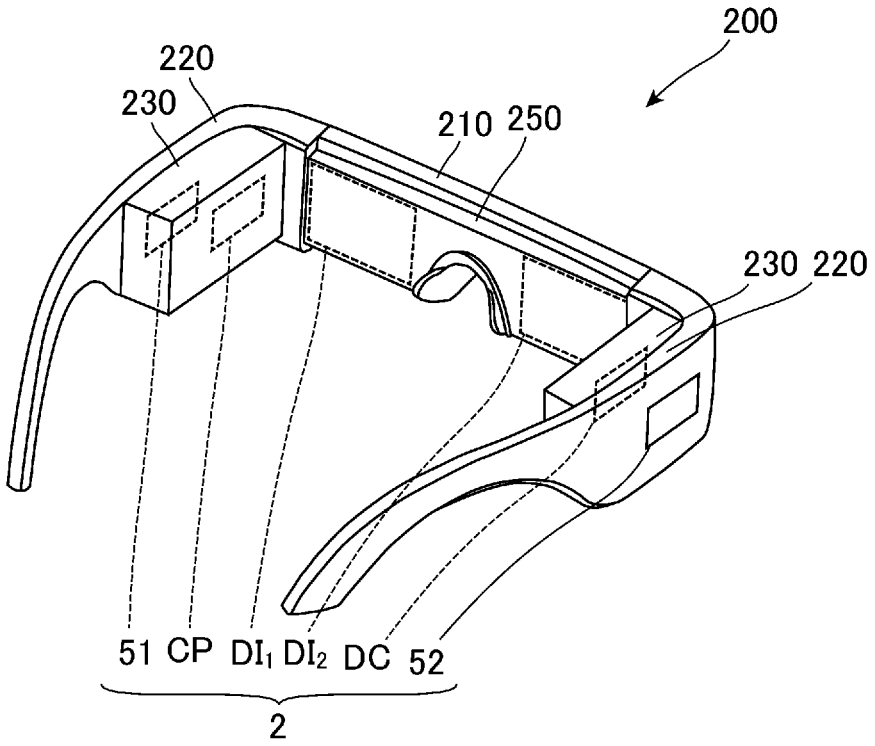
FIG. 6 is a schematic diagram illustrating a circumstance in which the electro-optical apparatus according to the aspect of the invention is applied to a head mounted display.

FIG. 6 is a schematic diagram illustrating a circumstance in which the electro-optical apparatus according to the invention is applied to a head mounted display. As shown in FIG. 6, a head mounted display 200 of the embodiment is provided with a front frame 210 that is positioned in front of the head of a user, a pair of side frames 220 that are positioned on both sides of the head that is connected to both ends of the front frame 210, an optical panel 250 that covers the eyes fixed to the front frame 210, a circuit cover 230 that is fixed to the respective side frames 220, and an electro-optical apparatus 2.

The electro-optical apparatus 2 of the embodiment is configured the same as the electro-optical apparatus of the first embodiment other than the number of display portions being two. A pair of display portions $DI_1$, $DI_2$ are disposed within the optical panel 250, the display portion $DI_1$ is disposed in front of the left eye and the display portion $DI_2$ is disposed in front of the right eye. There is a configuration in which light emitted from the display portions $DI_1$, $DI_2$ is emitted from the optical panel 250, one display portion $DI_1$ is visually recognized by the left eye of the user and the other display portion $DI_2$ is visually recognized by the right eye of the user.

In addition, the head mounted display 200 of the embodiment is provided to be able to operate the luminance balance adjustment input portion 51 in one side frame 220 and is provided to be able to operate the overall brightness adjustment input portion 52 in the other side frame 220. In addition, in the head mounted display 200 of the embodiment, the control portion CP is disposed within the circuit cover 230 that is fixed to the one side frame 220 and the power supply circuit DC is disposed within the circuit cover 230 that is fixed to the other side frame 220. However, the dispositions are able to be appropriately modified.

Typically, in the head mounted display, there is demand for brightness of the image visually recognized by the user to be modified. With respect to such a demand, in the head mounted display 200 of the embodiment, it is possible to modify brightness of the image by modifying the overall brightness of the electro-optical apparatus 2 in the same manner as in the description of the first embodiment. In addition, in a case where there is the pair of display portions $DI_1$, $DI_2$, one display portion $DI_1$ is visually recognized from one eye of a person, and the other display portion $DI_2$ is visually recognized from the other eye of the person, there is a tendency for the user to feel discomfort when the luminance of the respective display portions $DI_1$, $DI_2$ is different, and there is demand to adjust luminance of left and right display portions $DI_1$, $DI_2$. With respect to such a demand, in the head mounted display 200 of the embodiment, in the electro-optical apparatus 2, it is possible to adjust luminance balance between the left and right display portions $DI_1$, $DI_2$ in the same manner as in the description of the first embodiment. Then, it is possible to independently modify brightness of the image and adjust luminance balance between the left and right display portions $DI_1$, $DI_2$.

Third Embodiment

Next, a third embodiment of the invention will be described in detail with reference to FIG. 7. Note that, except as specifically described, the same or similar configuration elements as the first embodiment are given the same reference numerals and overlapping description is omitted.

Figure 7:
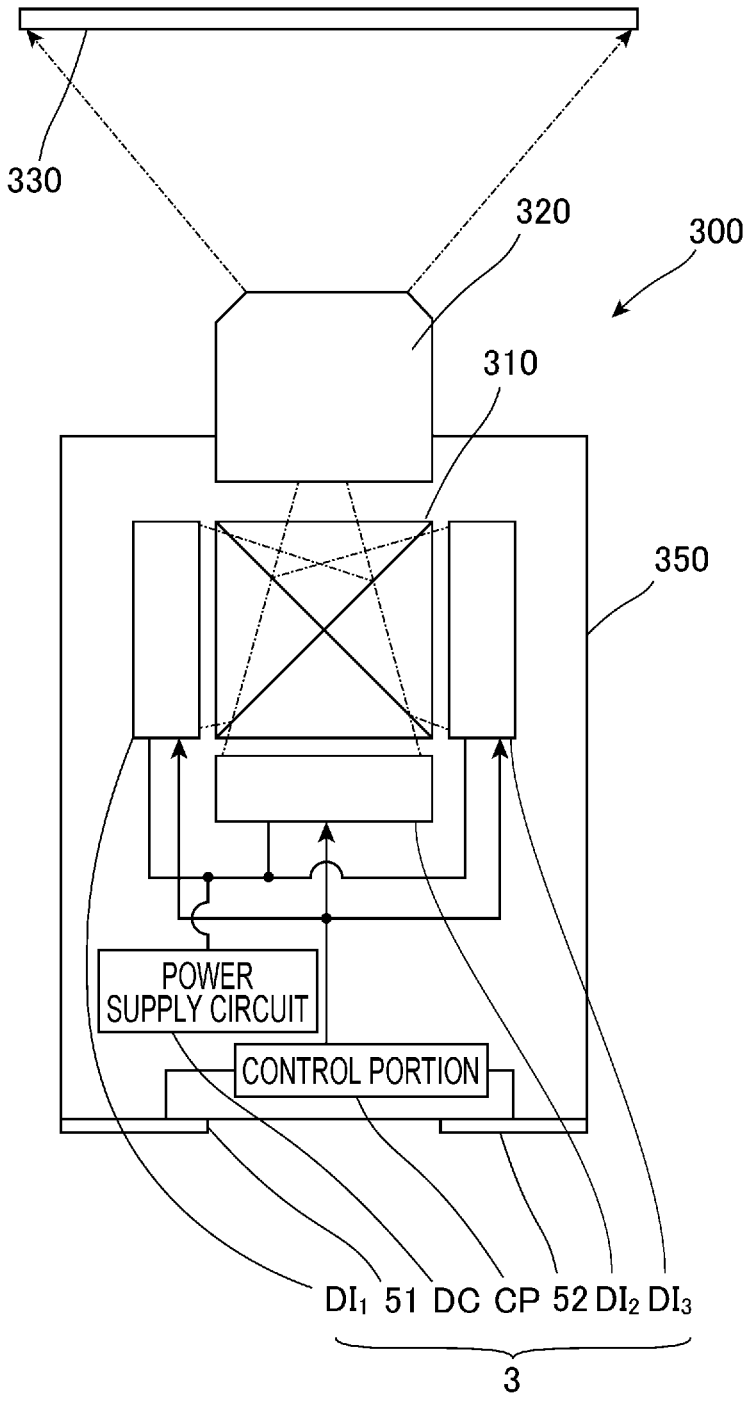
FIG. 7 is a schematic diagram illustrating a circumstance in which the electro-optical apparatus according to the aspect of the invention is applied to a projector.

FIG. 7 is a schematic diagram illustrating a circumstance in which the electro-optical apparatus according to the invention is applied to a projector. As shown in FIG. 7, a projector 300 is provided with a casing 350, an electro-optical apparatus 3, a dichroic prism 310, and a projection lens 320.

The electro-optical apparatus 3 of the embodiment is configured the same as the electro-optical apparatus of the first embodiment other than the number of display portions being three. Each display portion $DI_1$, $DI_2$, $DI_3$ is disposed within the casing 350, and each pixel array PA of display portions $DI_1$, $DI_2$, $DI_3$ is provided with monochrome pixels P. In the embodiment, the display portion $DI_1$ displays a red image, the display portion $DI_2$ displays a green image, and the display portion $DI_3$ displays a blue image. In addition, the respective display portions $DI_1$, $DI_2$, $DI_3$ are disposed such that an emission direction of light of the display portions that are adjacent to each other is roughly 90 degrees, in the embodiment, the display portion $DI_1$ and the display portion $DI_2$ are adjacent, the display portion $DI_2$ and the display portion $DI_3$ are adjacent, and the display portion $DI_1$ and the display portion $DI_3$ are disposed to face each other.

The dichroic prism 310 is disposed on a position that encloses each display portion $DI_1$, $DI_2$, $DI_3$, and each display portion $DI_1$, $DI_2$, $DI_3$ and a light incidence surface that is the side surface of the dichroic prism 310 face each other. In addition, the projection lens 320 is disposed on an emission surface side of light of the dichroic prism 310, and it is possible to emit light within the casing 350 outside of the casing 350 via the projection lens 320. Note that, the projection lens 320 may be configured by one lens or configured by a plurality of lenses.

In addition, the luminance balance adjustment input portion 51 and the overall brightness adjustment input portion 52 are provided to be able to be operated outside of the casing 350.

During usage of the projector 300, red light emitted from the display portion $DI_1$, green light emitted from the display portion $DI_2$, and blue light emitted from the display portion $DI_3$ are superimposed on each other, and a color image on which a red image, a green image, and a blue image overlap is projected on the screen 330. Note that, the screen 330 may be a light transmission type or a light reflecting type screen.

During use of the projector 300, there is demand for brightness of light emitted from the projector 300 to be modified according to brightness of a room in which the projector 300 is used. With respect to the demand, in the projector 300 of the embodiment, it is possible to modify brightness of light emitted from the projector 300 by modifying the overall brightness of the electro-optical apparatus 3 in the same manner as in the description of the first embodiment. In addition, there is demand for white balance to be adjusted in a color image projector such as the projector 300 of the embodiment. With respect to the demand, in the projector 300 of the embodiment, it is possible to adjust luminance balance of red, green, and blue and it is possible to adjust the white balance by adjusting luminance balance between the three display portions $DI_1$, $DI_2$, $DI_3$ of the electro-optical apparatus 3 in the same manner as in the description of the first embodiment. Then, it is possible to independently modify the brightness of light emitted from the projector 300 and adjust white balance.

Note that, in the embodiment, the display portions $DI_1$, $DI_2$, $DI_3$ are not limited to emitting light of only the specific colors of red, green, and blue described above, and may emit light of another color.

In addition, in the embodiment, a case where each display portion $DI_1$, $DI_2$, $DI_3$ displays an image of red, green, and blue is described, but each display portion $DI_1$, $DI_2$, $DI_3$ may be a light source of red, green, and blue without each of the respective display portions $DI_1$, $DI_2$, $DI_3$ displaying an image. In this case, an image may be displayed based on light emitted from each display portion $DI_1$, $DI_2$, $DI_3$ using a liquid crystal panel by disposing the liquid crystal panel or the like in front of each display portion $DI_1$, $DI_2$, $DI_3$.

Fourth Embodiment

Next, a fourth embodiment of the invention will be described in detail with reference to FIG. 8. Note that, except as specifically described, the same or similar configuration elements as the first embodiment are given the same reference numerals and overlapping description is omitted.

Figure 8:
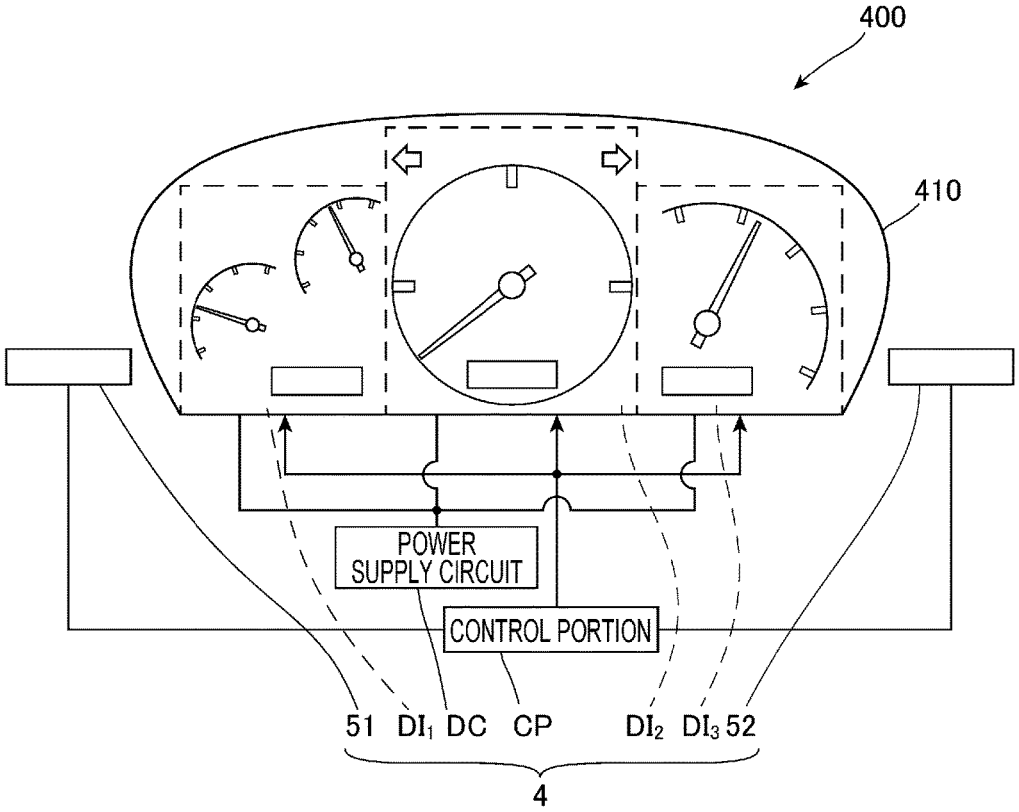
FIG. 8 is a schematic diagram illustrating a circumstance in which the electro-optical apparatus according to the aspect of the invention is applied to a vehicle display device.

FIG. 8 is a schematic diagram illustrating a circumstance in which the electro-optical apparatus according to the invention is applied to an on-vehicle meter. An on-vehicle meter 400 as indicated in FIG. 8 is provided with an electro-optical apparatus 4 that has three display portions $DI_1$, $DI_2$, $DI_3$.

In the embodiment, the respective display portions $DI_1$, $DI_2$, $DI_3$ are lined up side by side. In detail, in the embodiment, the size of the pixel arrays PA of the respective display portions $DI_1$, $DI_2$, $DI_3$ are different, and pixel arrays PA of the respective display portions $DI_1$, $DI_2$, $DI_3$ are lined up side by side. Note that, the control line driving circuit 10 and the data line driving circuit 20 of the respective display portions $DI_1$, $DI_2$, $DI_3$ are positioned on the back surface of the pixel array PA.

The display portion $DI_2$ positioned in the center has a pixel array size slightly larger than the left and right display portions $DI_1$, $DI_3$, and one on-vehicle meter 400 that is exposed from an opening portion 410 of a dashboard of a vehicle is configured by the three display portions $DI_1$, $DI_2$, $DI_3$.

For example, a fuel gage, a water temperature gage, and the like are displayed on the left side display portion $DI_1$, for example, a speedometer, a direction indicator, and the like are displayed on the center display portion $DI_2$, and for example, a tachometer and the like are displayed on the right side display portion $DI_3$. Note that, FIG. 8 indicates a state in which there is an analog display, but there may be a digital display.

In such an on-vehicle meter 400, there is demand to modify overall brightness of the on-vehicle meter 400 by an occupant. With respect to the demand, in the on-vehicle meter 400 of the embodiment, it is possible to modify brightness of the on-vehicle meter 400 by modifying the overall brightness of the electro-optical apparatus 4 in the same manner as in the description of the first embodiment. In addition, in the on-vehicle meter 400, with respect to the occupant, there is an important display and a not so important display, and there is demand to modify brightness according to the content of the display. For example, there is demand to brighten display of the speedometer, the direction indicator, and the like or display of the tachometer and the like in comparison to display of the fuel gage, the water temperature gage, and the like. Alternatively, there is demand to set overall display to a uniformized brightness. With respect to the demand, in the on-vehicle meter 400 of the embodiment, it is possible to set luminance of the display portion $DI_1$ to be lower than the display portions $DI_2$, $DI_3$, and it is possible to relatively brighten display of the speedometer, the direction indicator, and the like or display of the tachometer and the like in comparison to display of the fuel gage, the water temperature gage, and the like by adjusting the luminance balance between the three display portions $DI_1$, $DI_2$, $DI_3$ in the same manner as in the description of the first embodiment.

Modification Example

First to fourth embodiments are described above as examples of the invention, but the invention is not limited thereto.

For example, the configuration of each pixel P may be different from the embodiments, or arrangement of the pixel P in the pixel array PA may be different from the embodiments. There is a configuration in which a transistor included in the pixel P is a P channel transistor, a writing signal is applied by applying the L level voltage when the first control line is selected, and the H level voltage is applied when the first control line is not selected.

In addition, in the embodiment, the third transistor Tr3 is disposed on the current path from the power supply line VL to the light-emitting element Le, and current flow to the light-emitting element Le is switched by switching conduction and blocking of the current path by switching the third transistor Tr3 on and off. However, the invention is not limited thereto. For example, the position at which the third transistor Tr3 is disposed is not limited thereto. In this case, for example, there may be a configuration in which the gate of the third transistor Tr3 is connected to the second control line SL2, one of the source and drain of the third transistor Tr3 is connected to the other of the source and the drain of the first transistor Tr1 of the embodiment and one pole of a capacitative element, and the other of the source and drain of the third transistor Tr3 is grounded. In this case, an anode of the light-emitting element Le of the embodiment and the other of the source and drain of the second transistor Tr2 may be connected. Configuring in this manner, the second transistor Tr2 is set to off by setting the voltage of the second control line to the H level and the third transistor Tr3 to on, or it is possible to set the second transistor Tr2 to on and switch conduction and blocking of the current path by setting the voltage of the second control line to the L level and the third transistor Tr3 to off. Accordingly, the input number of times and input time of current from the power supply line VL may be adjusted by controlling the third transistor Tr3 using voltage of the second control line.

Alternatively, there may be a configuration in which the third transistor Tr3 in the embodiment is omitted and the anode of the light-emitting element Le and the other of the source and drain of the second transistor Tr2 are connected. In this case, conduction and blocking of the current path may be switched by switching between the H level and the L level of the voltage that is applied from the power supply circuit DC to the power supply line VL. Accordingly, the input number of times and input time of current from the power supply line VL may be adjusted according to the voltage that is applied from the power supply circuit DC to the power supply line VL. In this case, preferably the power supply circuit DC is provided to each display portion $DI_1$ to $DI_n$, and the respective power supply circuits DC are controlled by the control portion. When voltage of the H level is applied to the power supply line VL, the voltage is divided in the second transistor Tr2 and the light-emitting element Le, and voltage of a threshold voltage or above is applied to the light-emitting element Le. When voltage of the L level is applied to the power supply line VL, the voltage of a threshold voltage or below is applied to the light-emitting element Le. Current input from the power supply line VL is stopped by applying the voltage of the L level to the power supply line VL.

In addition, in the embodiment, gradation control is carried out in each pixel P according to the signal from the data line, but there may be a configuration in which gradation control is not carried out.

In addition, in the embodiment, the luminance balance adjustment input portion 51 and the overall brightness adjustment input portion 52 are provided, and overall brightness adjustment or luminance balance adjustment is performed by operating input portions. However, the invention is not limited thereto. For example, the electro-optical apparatus has sensing means that senses surrounding brightness, and the control portion CP may send a control signal of overall brightness adjustment to the respective display portions according to the sensing result of the sensing means. In addition, for example, the on-vehicle meter 400 of the fourth embodiment may sense presence or absence of illumination of a headlight, the control portion CP may send the control signal of overall brightness adjustment to the respective display portions according to the presence or absence of illumination of the headlight, and overall brightness of the on-vehicle meter 400 may be modified. In addition, for example, the electro-optical apparatus has sensing means that senses intensity of light emitted from the respective display portions, and the control portion CP may send a control signal of luminance balance adjustment to the respective display portions according to the sensing result of the sensing means. For example, in the second embodiment, it is possible to perform luminance balance adjustment described above by detecting intensity of light emitted from the left and right display portions $DI_1$, $DI_2$.

In addition, in the embodiment, a state in which the pixel arrays PA of the respective display portions overlap is not particularly mentioned. However, the invention is not limited thereto, and the pixel arrays PA may overlap. In this case, it is possible to superimpose light emitted from the respective display portions on each other and it is possible to form one image by configuring such that the respective pixel arrays transmit light. Alternatively, the respective pixel arrays PA may be disposed on the same surface, and the pixels P of the pixel array PA of another display portion may be positioned between pixels P in the pixel array PA of a specific display portion. That is, pixels P of the plurality of display portions are disposed so as to be side to side to each other, and it is possible to pose as one display portion. In this case, it is possible to superimpose light emitted from the respective display portions PA on each other and it is possible to form one image. In the examples, for example, the number of display portions is three, one display portion displays a red image, another display portion displays a green image, and the remaining one display portion displays a blue image. In this case, it is possible to perform color display by superimposing light emitted from the respective display portions on each other. In addition, it is possible to modify overall brightness and adjust white balance in the same manner as in the electro-optical apparatus 3 of the third embodiment.

Figure 9:
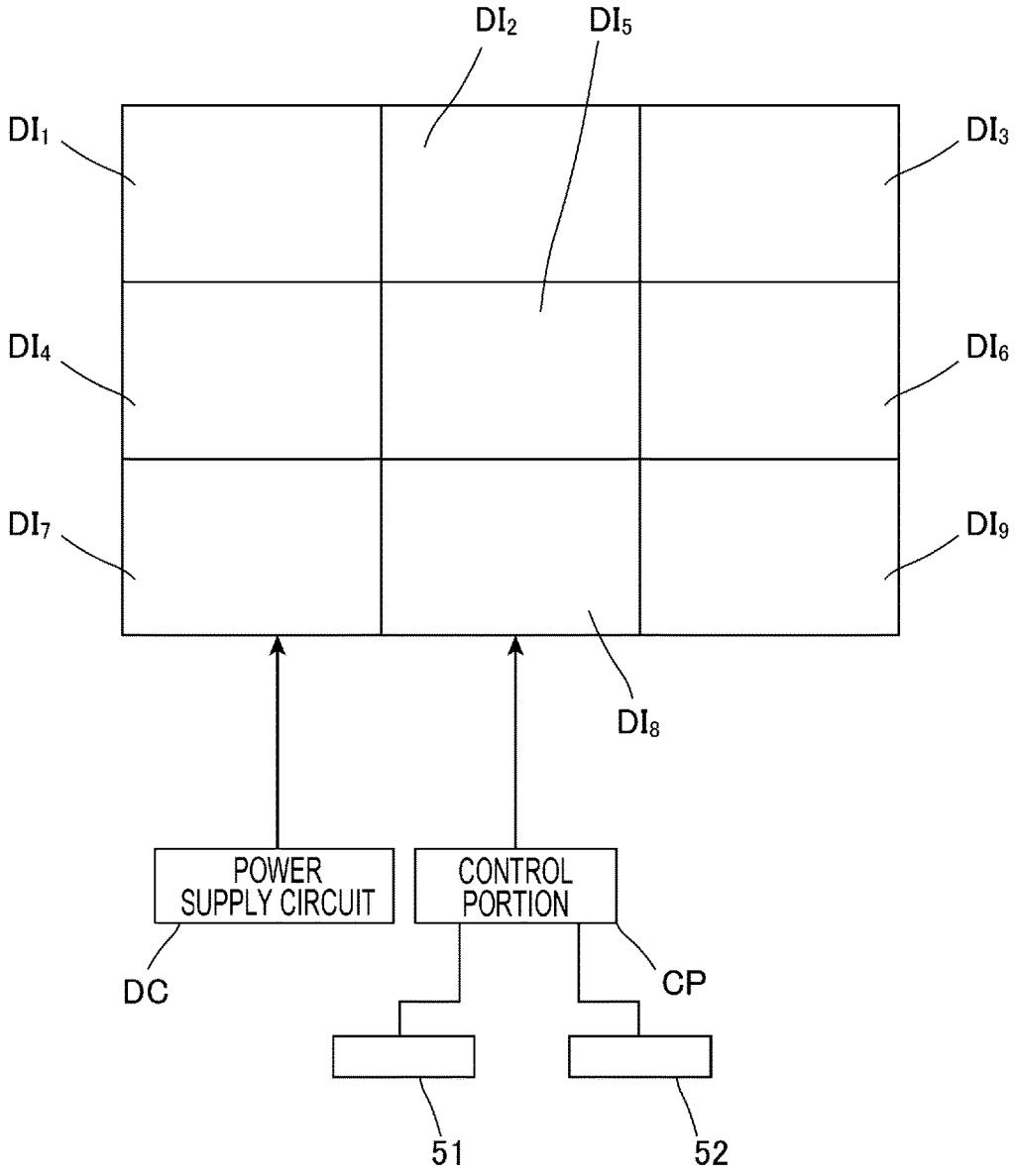
FIG. 9 is a schematic diagram illustrating an example in which each pixel array of each display portion of a first embodiment are lined up.

In addition, each pixel array PA of each display portion $DI_1$ to $DI_n$ of the first embodiment may be lined up. FIG. 9 is a schematic diagram illustrating an example in which each pixel array PA of each display portion $DI_1$ to $DI_n$ of the first embodiment are lined up. In the example indicated in FIG. 9, there are nine display portions of the electro-optical apparatus 1 of the first embodiment, and the pixel array PA of the display portions $DI_1$ to $DI_9$ are lined up in an array. In the embodiment, the control line driving circuit 10 and the data line driving circuit 20 of each display portion $DI_1$ to $DI_9$ are positioned on the back surface of the pixel array PA. In addition, description is simplified in FIG. 9, but the control portion CP and the power supply circuit DC are connected to each display portion $DI_1$ to $DI_9$ in the same manner as the electro-optical apparatus 1 of the first embodiment.

It is possible for the respective display portions $DI_1$ to $DI_9$ to be used as a display portion of one large screen by lining up the plurality of display portions $DI_1$ to $DI_9$ in an array. In the electro-optical apparatus 1, it is possible to project one video as a whole, and it is also possible to project the same video on the respective display portions $DI_1$ to $DI_9$.

In the electro-optical apparatus 1 in which the display portions $DI_1$ to $DI_9$ of the example are lined up in an array, there is demand to modify overall brightness, and it is possible to adjust overall brightness in the same manner as the first embodiment with respect to the demand. In addition, the electro-optical apparatus 1 in which the display portions $DI_1$ to $DI_9$ are lined up in an array, there is a tendency for a viewer to be imparted with a sense of discomfort in a case where luminance of some display portions is different from luminance of other display portions. Therefore, in the electro-optical apparatus 1 of the embodiment, there is demand to adjust luminance balance between display portions. With respect to the demand, in the electro-optical apparatus 1 of the embodiment, it is possible to adjust luminance balance between each display portions $DI_1$ to $DI_9$ in the same manner as in the description of the first embodiment.

The entire disclosure of Japanese Patent Application No. 2016-014066, filed Jan. 28, 2016 is expressly incorporated by reference herein.

What is claimed is:

1. An electro-optical apparatus comprising:

a plurality of display portions; and a control portion, wherein the respective display portions have a plurality of pixels disposed corresponding to each intersecting position at which a plurality of scanning lines and a plurality of data lines intersect, each of the plurality of pixels has a light-emitting element that emits light using current that is input at a predetermined cycle from a power supply line in a period from a selection of a scanning line until a next selection of the scanning line, and the control portion controls the display portions such that one of an input number of times of current from the power supply line to the light-emitting element in the period and an input time of current from the power supply line to the light-emitting element in each of the predetermined cycles changes in conjunction with each other in the display portions that are different from each other, and the other one of the input number of times of current and the input time of current changes independently from each other in the display portions that are different from each other.

2. The electro-optical apparatus according to claim 1, wherein there is a pair of display portions, and one display portion is visually recognized by one eye of a person, and the other display portion is visually recognized by the other eye of the person.

3. The electro-optical apparatus according to claim 1, wherein the display portion emits light of different colors from each other, and superimposes light that is emitted from respective display portions on each other.

4. The electro-optical apparatus according to claim 2, wherein the control portion controls such that the input number of times of current from the power supply line to the light-emitting element in the period changes in conjunction with each other in the display portions that are different from each other, and the input time of current from the power supply line to the light-emitting element in each of the predetermined cycles changes independently from each other.

5. The electro-optical apparatus according to claim 1, wherein the predetermined cycle is a cycle in which the respective scanning lines are sequentially selected.

6. A control method of an electro-optical apparatus, the electro-optical apparatus including a plurality of display portions and a control portion, in which the respective display portions have a plurality of pixels disposed corresponding to each intersecting position at which a plurality of scanning lines and a plurality of data lines intersect, each of the plurality of pixels has a light-emitting element that emits light using current that is input at a predetermined cycle from a power supply line in a period from a selection of a scanning line until a next selection of the scanning line, and the control portion controls the display portions such that one of an input number of times of current from the power supply line to the light-emitting element in the period and an input time of current from the power supply line to the light-emitting element in each of the predetermined cycles changes in conjunction with each other in display portions that are different from each other, and the other one of the input number of times of current and the input time of current changes independently from each other in the display portions that are different from each other.

* * * * *